US007069606B2

(12) United States Patent
Verschuere et al.

(10) Patent No.: US 7,069,606 B2
(45) Date of Patent: Jul. 4, 2006

(54) DEVICE FOR ATTACHING A SLAT TO THE FRAME OF A SLATTED BASE

(75) Inventors: Frank Verschuere, Kalken (BE); Peter De Meyer, Sint-Laureins (BE)

(73) Assignee: LS Bedding, Maldegem (BE)

( * ) Notice: Subject to any disclaimer, the term of this patent is extended or adjusted under 35 U.S.C. 154(b) by 0 days.

(21) Appl. No.: 10/727,669

(22) Filed: Dec. 5, 2003

(65) Prior Publication Data

US 2004/0107499 A1 Jun. 10, 2004

(30) Foreign Application Priority Data

Dec. 6, 2002 (EP) ..... 02447246

(51) Int. Cl.
*A47C 23/06* (2006.01)

(52) U.S. Cl. ..... 5/236.1; 5/5; 5/237; 5/238

(58) Field of Classification Search ..... 5/236.1, 5/191, 237–238, 236, 239, 241–244
See application file for complete search history.

(56) References Cited

U.S. PATENT DOCUMENTS 4,752,981 A * 6/1988 Salens ..... 5/238
5,924,149 A * 7/1999 Weber ..... 5/238
6,237,170 B1 5/2001 Salens

FOREIGN PATENT DOCUMENTS

CH 678447 A5 9/1991
DE 196 46 633 A1 10/1997
DE 100 33 003 C 1 10/2001
DE 100 49 946 A 1 4/2002
EP 1 013 200 B1 7/2003

* cited by examiner

*Primary Examiner*—Jong-Suk (James) Lee
*Assistant Examiner*—Frederick Conley
(74) *Attorney, Agent, or Firm*—Pillsbury Winthrop Shaw Pittman LLP

(57) ABSTRACT

The present invention relates to device for attaching at least one slat of a slatted base to a frame of the slatted base, the device comprising a first member (2) arranged to be attached to the inner side of the frame of the slatted base and comprising first connecting means (5'); a second member (1) comprising a top portion (1") arranged to engage an extremity of at least one slat of the slatted base, a base portion (1') connected to the top portion by means of at least one resilient member (4), and second connecting means (5) arranged to cooperate with the first connecting means (5') so as to allow connecting the first member (2) to the second (1) member in a plurality of relative positions with respect to each other in view of adjusting the position of the at least one slat with respect to the frame of the slatted base. The resilient member (4) and second connecting means (5) are disposed with respect to each other on the second member (1) in such a way that when compressing the resilient member (4), the top portion (1") of the second member (1) is displaceable with respect to the frame in the height adjustment direction of the least one slat, to the level of the second connecting means (5). Therefore, for a given compression amplitude of the resilient member, the height of said second member can be reduced comparatively with second members of devices according to the prior art.

14 Claims, 5 Drawing Sheets

DEVICE FOR ATTACHING A SLAT TO THE FRAME OF A SLATTED BASE

CROSS REFERENCE TO RELATED APPLICATIONS

This Application claims priority to European Patent Application No. 02447246.6, filed Dec. 6, 2002, the content of which is incorporated herein in its entirety by reference.

BACKGROUND OF THE INVENTION

1. Field of the Invention

The present invention relates to a device for attaching at least one slat of a slatted base to a frame of the slatted base, the device comprising a first member arranged to be attached to the inner side of the frame of the slatted base and comprising first connecting means; a second member comprising a top portion arranged to engage an extremity of at least one slat of the slatted base, a base portion connected to the top portion by means of at least one resilient member, and second connecting means arranged to cooperate with the first connecting means so as to allow connecting the first member to the second member in a plurality of relative positions with respect to each other in view of adjusting the position of the at least one slat with respect to the frame of the slatted base, according to the preamble of the first claim.

2. Description of the Related Art

Such a device is known in the art and is disclosed in U.S. Pat. No. 4,752,981. This known device comprises a first member which is arranged to be attached to the inner side of the frame of a slatted base and which comprises first connecting means. The known device also comprises a second member having a top portion arranged for engaging an extremity of at least one slat of the slatted base, a base portion which is connected to the top portion by means of at least one resilient member and second connecting means which are provided to co-operate with the first connecting means, so as to allow connecting the first member to the second member to each other, in various relative positions with respect to each other. In that way the position of the at least one slat with respect to the frame of the slatted base is adjustable.

From DE-A-10049946 a device is known, comprising a first member which is provided to be attached to the frame of a slatted base at two possible positions in height direction of the frame, and a second member which is connectable to the first member and which is provided for receiving two side by side disposed slats of the slatted base. The second member comprises a top portion having means for receiving two side by side disposed slats. Below this top portion two resilient members are disposed, which in turn are positioned on top of the second connecting means of the second member. The position of the slats when engaged in the top portion of the second member is adjustable in height direction of the frame of the slatted base between two extreme positions, which are determined by the two possible positions of the first member with respect to the frame. Because the resilient members of the second member are located above the second connecting means, the slats received in the top portion of this second member will always remain at a position above the second connecting means, even when compressed by the weight of a person lying on the slatted base. As a consequence, the height of the second member, as well as the height of the slatted base as a whole will be relatively large. This implies that in many bed structures, the bottom of a mattress lying on the slatted base of DE 10049946 A1 will extend above the sides of the slatted base because of its huge height and therefore the mattress will not be properly held in place by said sides.

The same problem arises with the device disclosed in EP 1013200 B1, which comprises a first member to be mounted to the frame of a slatted base and a second member provided to receive slats of the slatted base, the first and second member being connectible to each other. The second member comprises a flexible bent arm whose upper and lower ends are connected to each other by means of a central piece. The upper end of the bent arm is connected to a top portion arranged for receiving the extremities of two slats of a slatted base. The lower end of the bent arm is connected to the base portion of the second member, onto which the second connecting means are provided for connecting the second member to first connecting means of the first member. The second connecting means consist in pins to be received in the first connecting means. The first connecting means consist of a plurality of passages disposed above each other in the height direction of the frame of the slatted base. While the bent arm and central piece of the resilient member extend at the position of the connecting pins of the first member below the slats, the top end of the bent arm projects above the pins in such a way that the slats whose extremities are engaged in the top portion of the second member, are always positioned above the second connecting means, even when the resilient members are compressed by the weight of a person lying on the slatted base. This thus leads to the same problem as with the device according to DE 10049946 A1.

CH 678447 describes a further device of the kind of those described above.

SUMMARY OF THE INVENTION

It is the object of the present invention to provide a device for attaching at least one slat, the position of the slat being adjustable in such a way that a mattress positioned on top of the slatted base may be received within the frame of the slatted base.

This problem is solved by the present invention, with the technical features of the characterizing part of the first claim.

The device of the present invention solves this problem in providing a device for attaching at least one slat of a slatted base to the frame of the slatted base in such a way that the position of the slat is adjustable in height direction of the frame, in which the resilient member and the second connecting means of the second member are disposed in such a way with respect to each other that upon compression of the resilient member, the top portion of the second member is displaceable in height adjustment direction of the slat with respect to frame, to the level of the second connecting means.

Because of the specific configuration of the resilient member and the second connecting means of the device of this invention, for a given compression amplitude of the resilient member, the height of the second member can be reduced as compared to the second members of the state of the art devices.

Therefore, in contrast to the slatted base known from the art, a mattress lying on a said slatted base comprising the device of the present invention for connecting the slats to the frame of the slatted base, will properly be held in place by said sides of the bed structure due to the fact that the slatted base will not flush at these sides. With the device of the present invention namely the total height of said slatted base may be limited as compared to the state of the art devices and therefore, the risk to extension of the bottom of the mattress above said sides can be minimised.

Preferred embodiments of the invention are described in the dependent claims.

BRIEF DESCRIPTION OF THE DRAWINGS

Other details and advantaged of the invention will appear from the following description and figures, which are given as examples which do not restrict the scope of the invention, and in which.

DETAILED DESCRIPTION OF THE INVENTION

The device of this invention for attaching at least one slat of a slatted base to the frame of a slatted base includes a first member 2 which is provided to be attached to the frame of the slatted base and a second member 1, which is provided to receive at least one slat. The first 2 and second 1 member comprise mutually co-operating connecting means for connecting them together and mounting the slats to the frame.

Figure 1A:
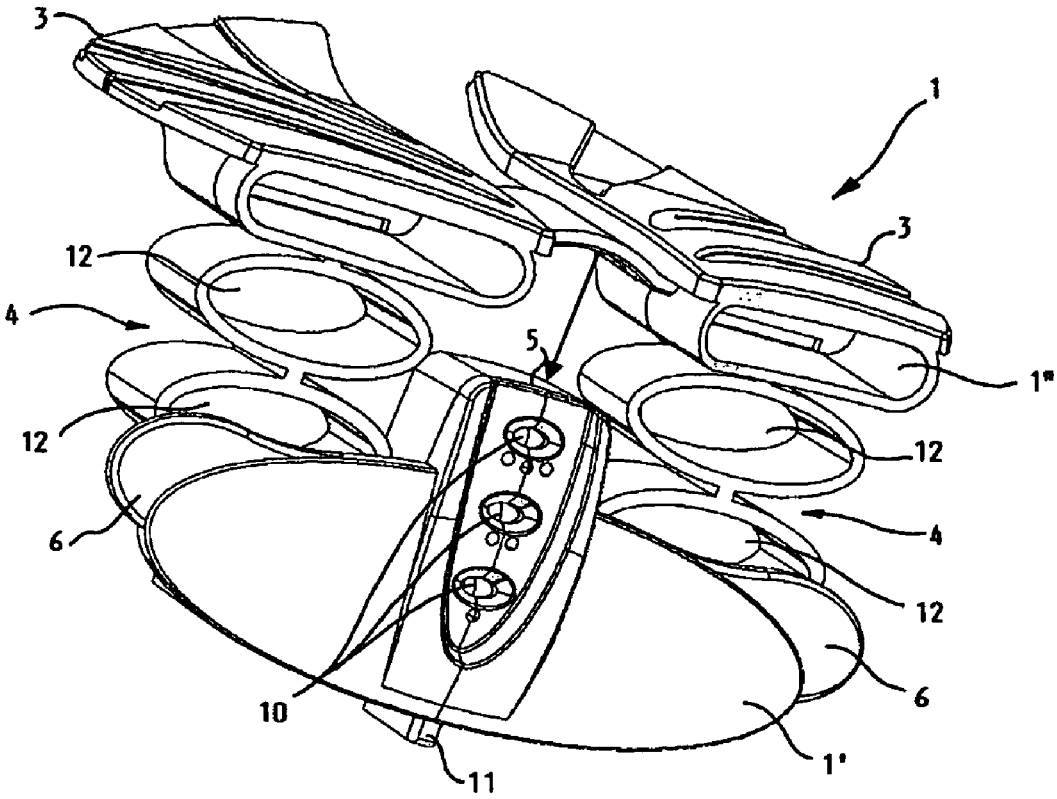
FIG. 1*a* shows a perspective view of the front of the second member of a device of this invention.
Figure 1B:
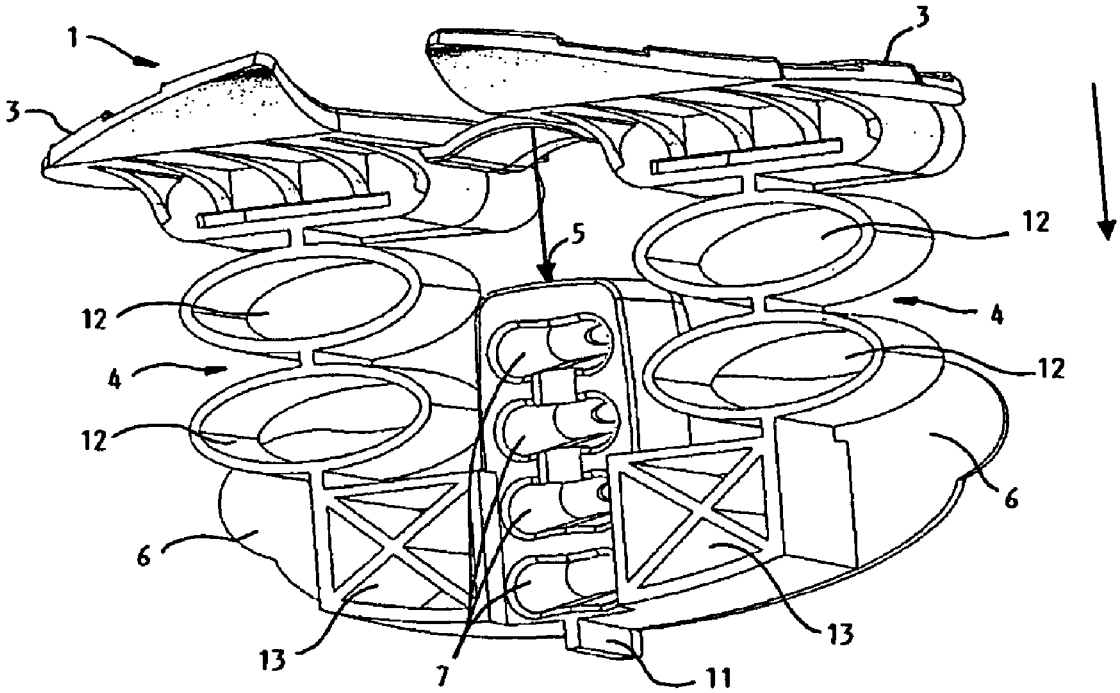
FIG. 1*b* shows is a perspective view of the back part of a second member of a device of this invention.
Figure 2:
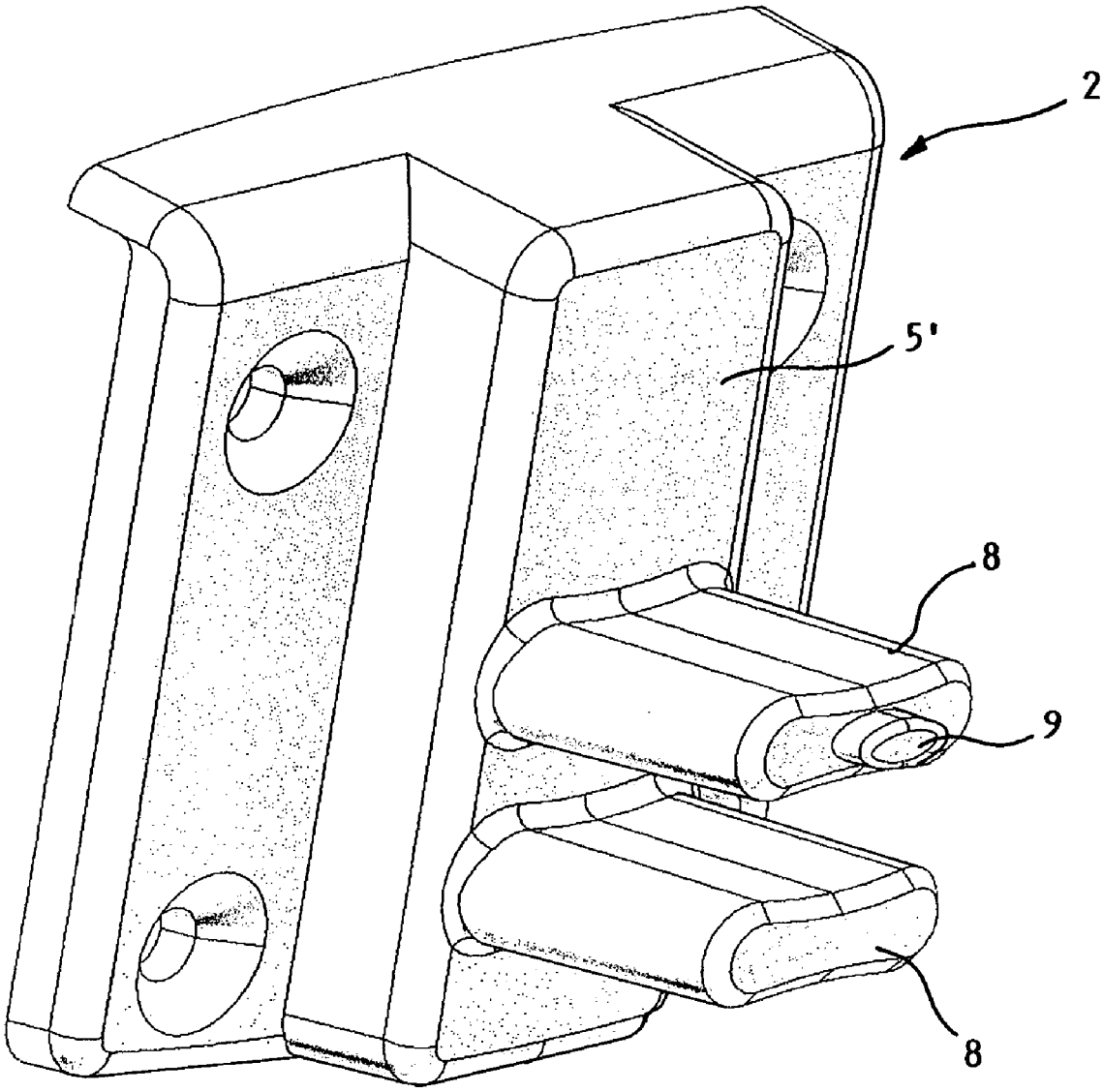
FIG. 2 shows a perspective view to the front of the first member of a device of this invention.

Referring to FIGS. 1*a*, 1*b* and 2, there is shown a second member 1 of a device of this invention. The second member comprises a rigid base portion 1' and a flexible top portion 1". The top portion 1" comprises a first and a second passage arranged to receive the extremities of a first and a second slat of a slatted base (not shown). The base 1' and top 1" portions of the second member 1 are positioned on opposite sides of a central axis dividing the second member in two parts. The base 1' and top 1" portions of the second member 1 are connected to each other by means of a first and a second resilient member 4 which are integral with the top 1" and bottom 1' portions of the second member 1. The top 1" and bottom 1' portions as well as the resilient members 4 may be made of the same type of material, for example a plastic material, for example synthetic rubber. Although being made of the same material, the top 1" and bottom 1' portions and the resilient members 4 may have different flexibility and degree of stiffness, due to the specific mechanical construction of each of these elements.

As can be seen from FIGS. 1*a* and 1*b*, each resilient member 4 comprises two superposed oval spring portions 12, which are positioned in such a way that the first and second passage of the top portion 1" for receiving a slat, are located respectively above the first and second resilient member 4. In addition to this, the first and second resilient members 4 are mounted on top of respectively a first and second support bloc 13. In a preferred embodiment, this support bloc is connected to or forms part of the base portion 1'.

The device of this invention comprises a first member 2, which is arranged for mounting on the frame of the slatted base. The second member 1 comprises second connecting means 5, which are arranged to cooperate with first connecting means 5' provided on the first member 2 of the device of this invention. The connecting means 5, 5' are designed so as to allow adjusting the position of the slats received in the top portion 1" of the second member 1, in height direction of the frame of the slatted base.

The first and second resilient members 4 are disposed on opposite sides of the second connecting means 5. Upon compressing the first and second spring members 4 by the weight of a person occupying the slatted base, the top portion 1" of the second member 1 can be displaced in downward direction in the compression direction of the resilient members 4, down to the level of the connecting means 5.

The connecting means 5 which connect the first member 2 to the second member 1, comprise a plurality of superposed recesses 7 spaced from each other in height direction of the slatted base. The recesses 7 have a truncated conical profile, as this facilitates the introduction of two a corresponding protrusion 8 on the first member 2, having a corresponding profile. Preferably, the first member 2 comprises a set of at least two protrusions 8 which are spaced from each other in height direction of the slatted base in such a way that successive protrusions 8 may be received in successive recesses 7. In particular, the protrusions 8 and recesses 7 have a cross section of a general oval shape having a central region tightened along the small axis of the oval, in order to ensure a firm grip between protrusions 8 and recesses 7 when the first member 2 and the second member 1 of the device are connected together by means of the first 5 and second 5' connecting means.

Truncated conical protrusions 8 and recesses 7 are angled of less than 90° relatively with the height adjustment direction of the slats of the slatted base relatively to said frame. This angled configuration of protrusions 8 and recesses 7 is provided to ensure that the weight of a person occupying the slatted base will result in an improved connection of the first 2 and second member 1. The angled positioning namely deviates forces originating from the weight of the person occupying the slatted base towards the inner side of the frame of the slatted base to which the first 2 member is attached.

The base portion 1' of the second member 1 comprises a protrusion 11 extending downwardly in height direction of the member and the slatted base, below the second connecting means 5. The protrusion 11 has a thickness which is larger than the distance separating two superposed protrusions 8 of the first connecting means 5' of the first member 2 of the device. This is done to ensure that the first and second connecting means 5 and 5' can only be connected to each other when both protrusions 8 of the first connecting means 5' are introduced into two superposed corresponding recesses 7 on the second connecting means 5. in that way a firm and strong connection between first and second members 2 and 1 of the device can be obtained.

Each recess 7 of the second connecting means comprises a bottom with a hole 10. Each protrusion of the first connecting means comprises a free end onto which a further protrusion or pin 9 is provided. When the protrusion 8 is fully inserted in a corresponding recess 7, the further protrusion 9 or pin is received in hole 10 and is visible. In that way visual identification of the relative position of the first and second members 2 and 1 is made possible, which relative position determines the position of the slats in height direction of the slatted base to which the first member 2 is attached.

The top portion 1" of the second member 1 of the device may further comprise a wing member 3, which extends in the direction of engagement of the first and second slats within said top portion 1". The wing member 3 is arranged for prolonging the extremities of the slats above the frame of the slatted base. This enables to position two slatted bases side-by-side without having a gap there between, in the benefice of the comfort of persons occupying such side-by-side placed slatted bases. The base portion 1' of the second member 1 of the device of this invention is further provided with two lateral flaps 6 disposed on each side of this base portion 1' and arranged for handling said second member. Thanks to the provision of the flaps 6, it is easy for a person to manipulate the second member of the device, to modify its relative position with respect to the first member and consequently to adjust the position of the slats of received within the top portion of the second member with relatively to the frame of the slatted base to which the first member is attached.

Figure 3:
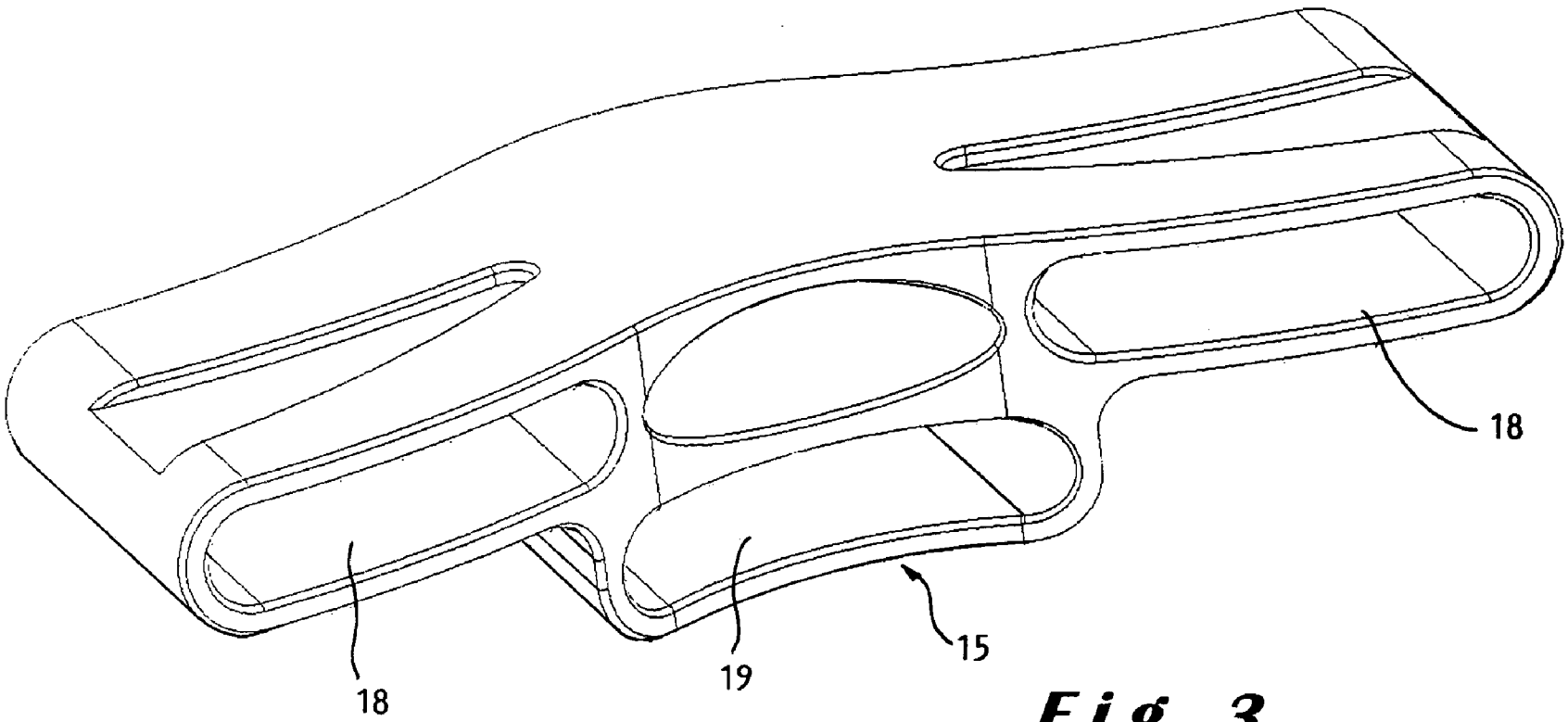
FIG. 3 shows a perspective view to the front of a leading member of a device of this invention.

Referring now to FIGS. 3, 4, 5*a* and 5*b*, there is shown in FIG. 3 a leading member or guiding 15 of a device of this invention. The leading member is provided to receive two slats (not shown) of a slatted base within its passages 18 in order to guarantee that the distance between adjacent slats is kept constant. The leading member 15 may further comprise a third passage 19 for receiving a third reinforcing slat (not shown), below the space separating the two slats received in the passages 18 of the leading member 15. This provision enables a local reinforcement of the structure of the slatted base, especially in its central region, when it is used by corpulent persons. The leading member 15 can be resilient similarly to the resilient members 4 of the second member of the device and can be constituted of the same synthetic rubber material or a different material.

Figure 4:
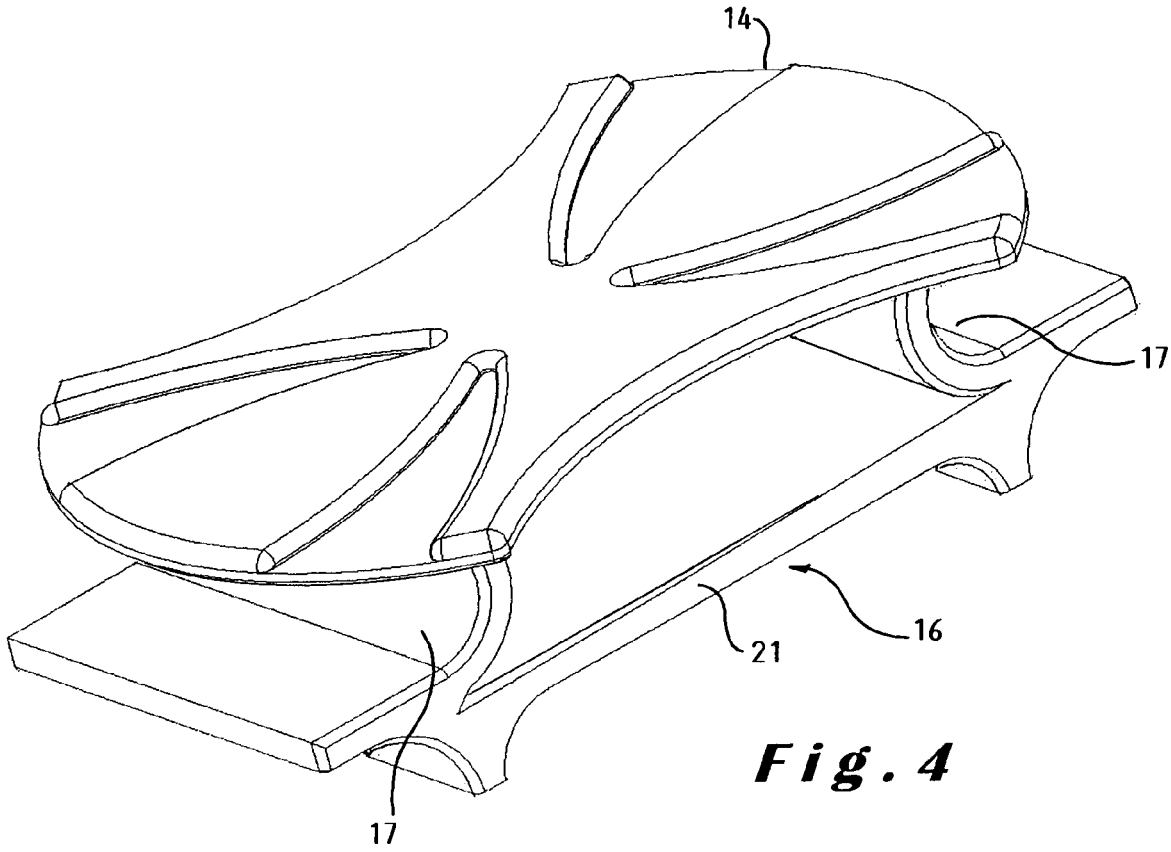
FIG. 4 shows a perspective view to the front of a positioning member of a device of this invention.

In FIG. 4, there is shown a positioning member 16 having a top portion 14 and two underlying side portions 17. The positioning member is further provided for use within the device of this invention. This positioning member 16 is provided to slide between two adjacent slats of the slatted base received in the passages 18 of the leading member 15. In that way it is achieved that opposite longitudinal edges of the slats are tightened between the top portion 14 and side portions 17 of the positioning member 16. The positioning member 16 may further comprise a bottom portion 21 having two lateral underlying protrusions aimed at maintaining the aforementioned third slat received in the third passage 19 of the leading member 15 in its central position with respect to the passages 18 of said leading member 15. Preferably, the positioning member 16 is located near the center of the slats taken in longitudinal direction of the slat.

Figure 5A:
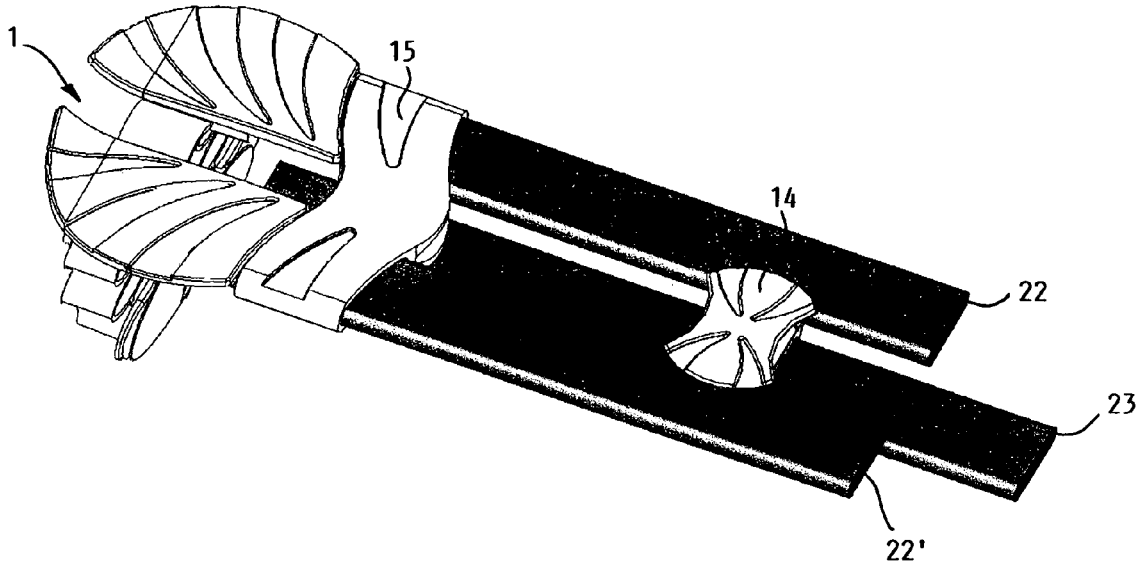
FIG. 5*a* is a perspective view from the top a first configuration of the leading member and the positioning member of a device of this invention when mounted on slats of a slatted base.
Figure 5B:
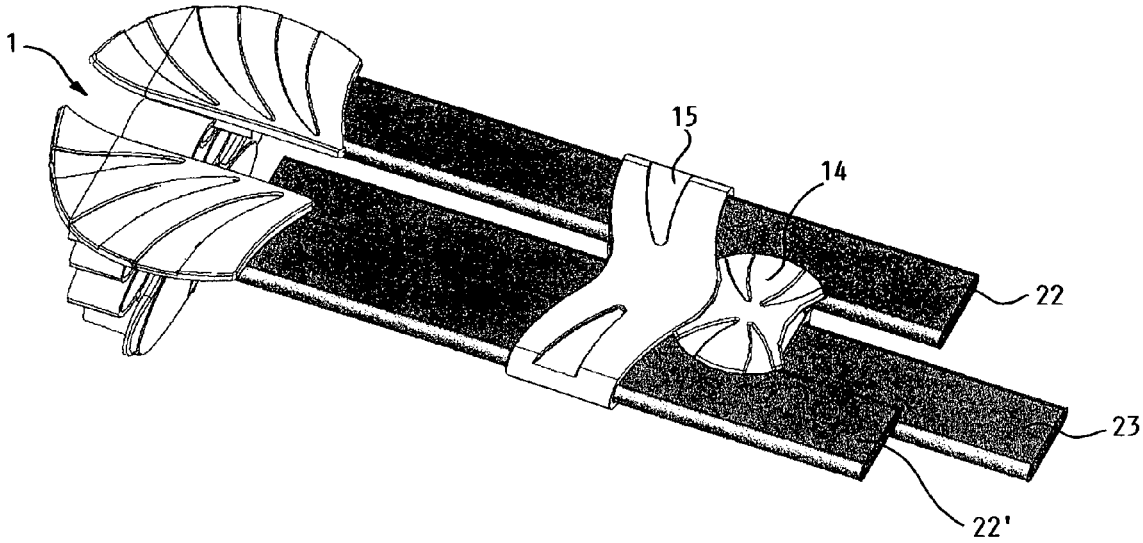
FIG. 5*b* is a perspective view to the top of a second configuration of the leading member and the positioning member of a device of the present invention when mounted to the slats of a slatted base.

FIG. 5*a* illustrates a first configuration of the respective positions of the leading member 15 and positioning member 16 in which said leading member is disposed along said positioning member when the latter is itself disposed near the longitudinal center of the slats 22, 22' and 23 received in passages 18 and 19 of the leading member 15. In this configuration, the reinforcement provided by the third slat 23 to the structure of the slatted base is minimal. FIG. 5*b* illustrates a second configuration of the respective positions of the leading member 15 and positioning member 16 in which said leading member is disposed mostly remote from said positioning member when the latter is itself disposed near the center of the length of the aforementioned slats 22, 22' and 23. In this configuration, the reinforcement provided by the third slat 23 to the structure of the slatted base is maximal. Between these two extreme configurations, several positions of the leading member 15 relatively to the positioning member 16 can be chosen in order to adapt the reinforcement afforded by the third slat 23 to the structure of the slatted base, namely in function of the specific weight of each person lying on said slatted base.

The invention claimed is:

1. A device for attaching at least one slat of a slatted base to a frame of the slatted base, the device comprising:

a first member arranged to be attached to the inner side of the frame of the slatted base and comprising first connecting means;

a second member comprising a top portion arranged to engage an extremity of at least one slat of the slatted base, a base portion connected to the top portion by means of at least one resilient member, and second connecting means arranged to cooperate with the first connecting means so as to allow connecting the first member to the second member in a plurality of relative positions with respect to each other in view of adjusting the position of the at least one slat with respect to the frame of the slatted base, wherein the resilient member comprises a first and a second part which are each connected to the base portion by means of a first connecting member, the second connecting means are connected to the base portion by means of a connecting member which is separate from the first connecting member, and the first and second part of the resilient member are disposed on opposite sides of the second connecting means in such a way that when compressing the resilient member, the top portion of the second member is, as a whole, translatable in the height adjustment direction of the least one slat, up to the level of the second connecting means.

2. A device as claimed in claim 1, wherein said second member comprises a first and a second resilient member, disposed on opposite sides of said second connecting means and in that said top portion of said second member is arranged for receiving the extremities of a first and a second slat of said slatted base in such a way that the extremity of the first slat is positioned on top of the first resilient member and the extremity of the second slat is disposed on top of the second resilient member.

3. A device as claimed in claim 1 or 2, wherein said first connecting means comprise at least one protrusion and said second connecting means comprise a plurality of recesses disposed above each other in the height adjustment direction of said at least one slat with respect to said frame, the recesses being provided for receiving said protrusion.

4. A device as claimed in claim 6, wherein said protrusion and recesses extend under an angle of less than 90° with respect to the height adjustment direction of said at least one slat.

5. A device as claimed in claim 3, wherein each of the recesses comprises a bottom with a hole through which a pin at an extremity of said protrusion is visible when engaging one of said recesses.

6. A device as claimed in claim 3, wherein said first connecting means comprises two protrusions arranged to be engaged within two successive recesses of said plurality of recesses of the second connecting means.

7. A device as claimed in claim 3, wherein each protrusion and each recess has a truncated conical shape.

8. A device as claimed in claim 1 or 2, wherein said base portion of said second member is rigid and in that said top portion of said second member is flexible.

9. A device as claimed in claim 1 or 2, wherein each resilient member is integral with said base and top portions of said second member.

10. A device as claimed in claim 1 or 2, wherein said top portion of said second member has a wing member extending in the direction of engagement of an extremity of a slat of said slatted base within said top portion and arranged for prolonging said extremity above the frame of said slatted base.

11. A device as claimed in claim 1 or 2, wherein the base portion of the second member comprises two lateral flaps for handling said second member.

12. A device as claimed in claim 1, wherein a portion of said second connecting means extends between said first and second part of said resilient member.

13. A device as claimed in claim 1, wherein the first connecting member includes a first and a second connecting portion that are disposed on opposite sides of the connecting member.

14. A device as claimed in claim 1, wherein the first and second part are disjoined.

* * * * *